US006817764B2

(12) United States Patent
O'Rourke et al.

(10) Patent No.: US 6,817,764 B2
(45) Date of Patent: Nov. 16, 2004

(54) PRESSURE VESSEL

(75) Inventors: Barbara Klimowicz O'Rourke, Richmond, VA (US); Mark Allan Lamontia, Landenberg, PA (US); Joseph Herbert Mason, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 10 days.

(21) Appl. No.: 10/284,215

(22) Filed: Oct. 30, 2002

(65) Prior Publication Data

US 2003/0141306 A1 Jul. 31, 2003

Related U.S. Application Data

(60) Provisional application No. 60/342,641, filed on Dec. 20, 2001.

(51) Int. Cl.[7] ..... B65D 33/16

(52) U.S. Cl. ..... 383/84; 383/61.1; 383/113; 383/107

(58) Field of Search ..... 383/5, 84, 85, 383/89, 117, 78, 61.1, 113, 107; 229/79; 206/524.5

(56) References Cited

U.S. PATENT DOCUMENTS 2,689,079 A * 9/1954 Timer ..... 206/521
4,679,688 A * 7/1987 Soderholm et al. ..... 206/204
5,077,001 A * 12/1991 Makowka ..... 383/5
5,150,971 A * 9/1992 Strong et al. ..... 383/84
5,217,307 A * 6/1993 McClintock ..... 383/81
5,405,197 A * 4/1995 Makowka ..... 383/5
5,509,255 A 4/1996 Rutledge
5,647,480 A 7/1997 Insley et al.
6,349,826 B1 * 2/2002 Kapik et al. ..... 206/363

FOREIGN PATENT DOCUMENTS

| | | | |
|---|---|---|---|
| EP | 0459311 | * 12/1991 | ..... 383/84 |
| GB | 1536784 | * 12/1978 | ..... 383/78 |
| GB | 2051003 | * 1/1981 | ..... 383/5 |

* cited by examiner

*Primary Examiner*—Jes F. Pascua

(57) ABSTRACT

An improved pressure vessel comprising a polymer inner bladder inside a containment envelope is provided which is well-suited for transporting hazardous materials therewithin via air transport. The improved pressure vessel features a seal placed over the closure of the containment envelope which has been found to suppress failure of the pressure vessel by creep which occurs as a result of the high internal pressure that the pressure vessel experiences at high altitudes. The seal also serves to indicate whether or not the containment envelope has been tampered with after having been sealed.

9 Claims, 2 Drawing Sheets

PRESSURE VESSEL

This application claims the benefit of U.S. Provisional Application No. 60/342,641 filed Dec. 20, 2000.

FIELD OF THE INVENTION

The present invention relates to the field of low cost, flexible pressure vessels, particularly containment envelopes having inner bladders therein.

BACKGROUND OF THE INVENTION

U.S. Pat. No. 5,509,255 discloses a low cost, flexible pressure vessel which comprises a flexible, air permeable containment envelope having an interior cavity and an access opening closed by a closure and a flexible, air tight, liquid impervious inner bladder having an interior cavity and an access opening closed by a closure, the inner bladder being disposed within the interior cavity of the containment envelope. The inner bladder in a fully expanded condition is larger than the containment envelope such that internal pressure acts upon the inner bladder to place the inner bladder in compression within the interior cavity of the containment envelope while placing the containment envelope in tension. The containment envelope is preferably a spunbonded olefin material available from E. I. DuPont de Nemours & Company, Inc., Wilmington, Del. (hereinafter "DuPont"), under the registered trademark Tyvek®. The inner bag may be a readily sealable polymer bag. The pressure vessel is well suited for transporting hazardous materials therewithin by air transport. Hazardous material within a container, e.g., a vial, bottle, petri dish or blood bag, is placed inside the inner bladder, so that if any hazardous material leaks from the container it will not escape the liquid impervious inner bladder.

The closure on the containment envelope of the pressure vessel is typically in the form of a flap which is held closed by means of a strip of hot melt adhesive which has been applied to the envelope during its manufacture.

A problem with the above described pressure vessel is that under the levels of pressure that the vessels are typically exposed to in use, the vessels have a tendency to burst open. Specifically, the closures, or flaps, of the containment envelopes have a tendency to open by creep failure. The failure begins as a pucker in the center of the closure which grows over time until the closure opens completely. Once the closure opens, the internal pressure in the inner bladder acts directly on the inner bladder itself causing the inner bladder to burst, as the inner bladder is a polymer bag of low strength.

An object of this invention is to provide an improved pressure vessel that will not open at pressures typically encountered at high altitudes.

An additional problem with the above described pressure vessel is that it is possible for someone to tamper with the contents of the pressure vessel once it is sealed such that it can not be detected by visual inspection. This may be accomplished by steaming open the closure of the containment envelope, tampering with the contents thereof, then applying additional adhesive to the closure flap and resealing the closure.

An object of the invention is to provide a pressure vessel that will indicate whether or not it has been tampered with after being sealed.

SUMMARY OF THE INVENTION

The present invention provides an improved pressure vessel, comprising:

a flexible, air permeable, liquid permeable, containment envelope having an interior cavity and an access opening closed by a closure and forming a seam;

a separate, flexible, air tight, liquid impervious, inner bladder having an interior cavity and an access opening, the inner bladder being disposed within the interior cavity of the containment envelope in an unexpanded state, wherein the inner bladder in a fully expanded condition outside of the containment envelope is larger than the interior cavity of the containment envelope; and a seal comprising a piece of flexible sheet material adhered to the exterior of the containment envelope over the seam.

DETAILED DESCRIPTION OF THE INVENTION

Figure 1:
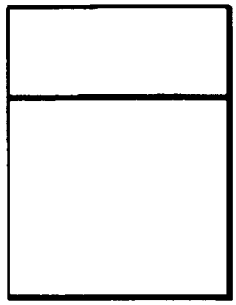
FIG. 1 (PRIOR ART)
FIG. 1 is a front view of a pressure vessel according to the prior art.

As seen in FIG. 1 illustrating a pressure vessel according to the prior art, the closure of the containment envelope, which forms the outer enclosure of the pressure vessel, is a folding flap which, when sealed, forms a seam with the body of the envelope. It is at the center of this flap where pucker and creep failure have been observed in the pressure vessels of the prior art.

The flap is preferably sealed by means of a strip of pressure-sensitive hot melt adhesive applied to the envelope during its manufacture. The strip of pressure-sensitive hot melt adhesive is applied to the envelope preferably on the underside of the flap, but it may also be applied to the body of the envelope opposite the underside of the flap. A removable protective release sheet protects the strip of adhesive until the time when the envelope is to be sealed. When the sheet is removed and the flap is folded onto the body of the envelope, a bond is formed upon contact. Moderate pressure is applied manually to ensure that the flap and the body of the envelope are securely sealed. The flap may also be sealed by means of a dry remoistenable adhesive applied on the underside of the flap. Suitable remoistenable adhesives include hot melt adhesives and liquid adhesives. In order to seal the containment envelope, the adhesive is moistened, activating the adhesive, and the flap is closed while the adhesive is still moist.

Figure 2:
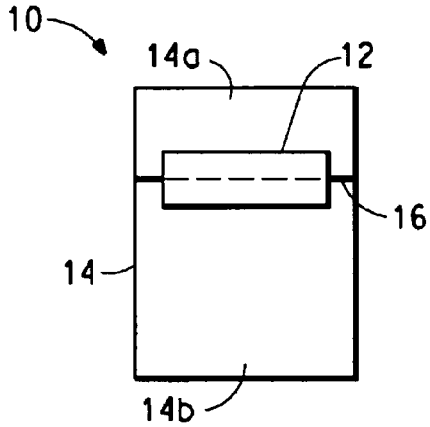
FIG. 2 is a front view of a pressure vessel according to one embodiment of the present invention.

As seen in FIG. 2 illustrating the improved pressure vessel 10 of the present invention, at least one piece of flexible sheet material 12 is adhered to the exterior of the containment envelope 14 directly over the seam 16 formed by the flap 14*a* and the body of the envelope 14*b*. The piece of flexible sheet material 12 is preferably in the form of an elongated strip, herein interchangeably referred to as a "strip seal" and a "seal." The strip preferably completely covers a major portion of the seam 16.

The strip seal is preferably adhered to the containment envelope by means of a pressure sensitive adhesive, a hot melt remoistenable adhesive or a liquid remoistenable adhesive. The adhesive is employed in a similar manner as described above for use on the underside of the flap of the containment envelope. If a pressure sensitive adhesive is employed on the seal, release paper protects the adhesive until the seal is to be affixed to the envelope, when the release paper is removed. If a remoistenable adhesive is used on the seal, the adhesive is moistened and the seal is affixed to the envelope.

The pressure vessel of the present invention is able to withstand an internal pressure differential of at least 95 kPa (14 psi) for at least 10 minutes, meeting the requirements of the International Air Transport Association's packaging instructions IATA 602 and 650, while remaining sealed and substantially dimensionally stable. By "substantially dimensionally stable" is meant that the flap 14*a* of the containment envelope remains sufficiently sealed during the application of internal pressure so that the inner bladder (not shown) remains contained and bursting of the pressure vessel is avoided. When under pressure, the pressure vessel is generally pillow shaped, even as it is opening as a result of creep.

In order for the pressure vessel to perform at a variety of temperatures and temperature changes, the containment envelope and the seal are preferably made from materials having similar coefficients of thermal expansion, most preferably from the same material. In one preferred embodiment, both the flexible sheet material forming the strip seal and the containment envelope comprise Tyvek® spunbond polyolefin sheet material, available from DuPont.

Figure 3:
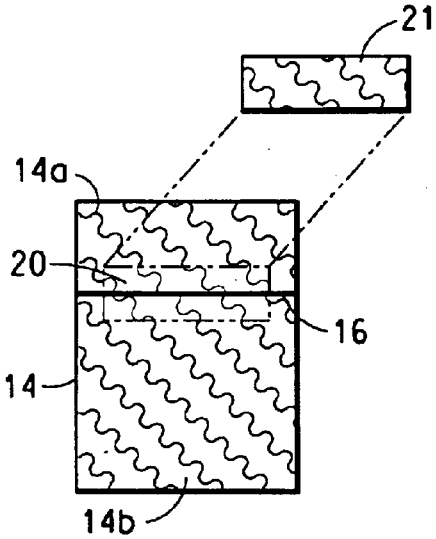
FIG. 3 is a front view of a pressure vessel according to another embodiment of the present invention.

In another embodiment, the seal 12 and the outer surface of the containment envelope 14 have coordinating decorations printed thereon, such that someone using the pressure vessel may easily determine the correct placement of the seal on the containment envelope. For example, as seen in FIG. 3, the closure flap 14*a* and the surface of the containment envelope to which the flap is adhered 14*b* may be printed in such a way that a design is formed when the flap is adhered to the envelope. The design will indicate a space 20 where the seal 21 is to be placed. The seal may be printed with a design which coordinates with the design on the containment envelope. Subsequent to being sealed, it is easily determined by visual inspection whether or not the seal has been properly placed and whether or not the pressure vessel has been tampered with.

Figure 4:
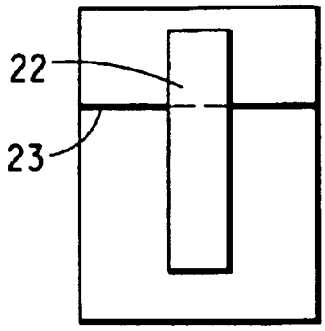
FIG. 4 is a front view of a pressure vessel according to another embodiment of the present invention.
Figure 5:
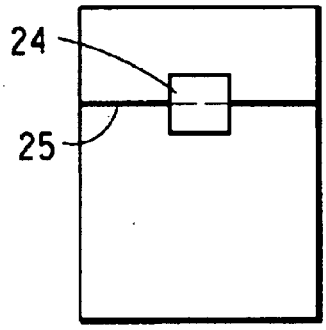
FIG. 5 is a front view of a pressure vessel according to another embodiment of the present invention.
Figure 6:
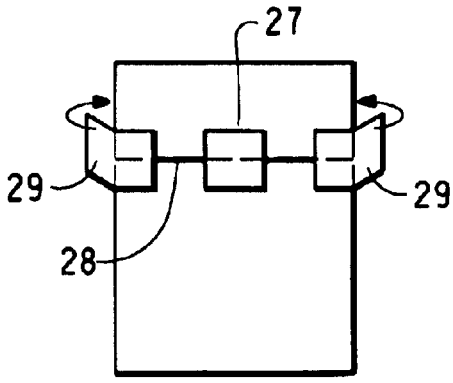
FIG. 6 is a front view of a pressure vessel according to another embodiment of the present invention.

FIGS. 4 through 6 illustrate other embodiments of the present invention. In FIG. 4, the seal 22 is in the form of an elongated strip as it was in FIG. 2, however, in this embodiment, the strip 22 is perpendicular to the closure seam 23 formed by the flap and the body of the containment envelope. In FIG. 5, the seal 24 is in the form of a rectangular tab located generally at the midpoint of the closure seam 25. In FIG. 6, the seal is in the form of three rectangular tabs, one of which 27 being located generally at the midpoint of the closure seam 28, and the other two tabs 29 being located over each end of the closure seam such that they wrap around to the opposite side of the containment envelope.

EXAMPLES

In the following non-limiting examples of the present invention, the following test methods were used.

Creep Test—The time to creep failure was measured as follows. With the air valve closed, a line supplying air from a compressed air source through a bulkhead fitting fitted securely into the pressure vessel was installed into the lower portion of the containment envelope and through the inner bladder. The bulkhead fitting was installed in the central lateral seam of the containment envelope, about five centimeters (two inches) from the bottom of the envelope so that the bulkhead fitting was inserted in a double layer area of the containment envelope. Once the inner bladder was inserted into the containment envelope, with the envelope and the inner bladder still open, a hole was punched through the inner bladder and containment envelope simultaneously with a hole-punch backed by wood. The wood was then removed. The bulkhead fitting was inserted and captured with a wing nut, both the wing nut and the bulkhead fitting having rubber washers, to seal the bulkhead fitting against the exterior of the containment envelope and the wing nut against the interior of the inner bladder.

The inner bladder was sealed securely. The closure flap of the containment envelope was sealed. Each of the seals being evaluated was adhered over the seam formed by the closure flap and the containment envelope. Using a black marker, marks were made over the seal and the containment envelope perpendicular to the seam in order to detect the creep displacement. An air pressure regulator was pre-set to 95 kPa (14 psi). An air valve was opened and once the pressure vessel was full, a timer was started. The length of time that the pressure was held constant was noted and recorded in minutes. This time was determined either by the pressure vessel bursting, or the test being concluded with the pressure vessel remaining intact.

In each of the following examples, 36 cm by 46 cm (14 3/16 in by 18 in) STP 741 polymer bags available from Saf-T-Pak, Inc. (Edmonton, Alberta, Canada) were used as the inner bladders, and 30 cm by 41 cm (12 in by 16 in) STP 740 Tyvek® envelopes (also available from Saf-T-Pak, Inc.) were used as the containment envelopes. The closure of the containment envelopes is defined by a 7.3 cm (2 7/8 in) flap across the full width of the envelope, with adhesive on the inner surface of the flap having the dimensions of 6.7 cm by 27 cm (2 5/8 in by 10 3/4 in). The containment envelopes were closed with HM-759 general purpose permanent pressure sensitive hot melt adhesive available from AccuBond Corporation (Downington, Pa.). The inner bladders and containment envelopes were assembled to form pressure vessels and were tested for time to creep failure, according to the Creep Test described herein, with and without a seal over the closure seam. The examples tested are described below.

In Comparison examples 1–9, the pressure vessel was tested with no seal over the closure seam.

In Comparison examples 10–12, the containment envelope was closed with two strips of double-stick tape from Minnesota Mining and Manufacturing (St. Paul, Minn.) manually applied on the underside of the envelope flap along the width of the envelope, one being 4.8 cm (1.9 in) wide and the other being 1.8 cm (0.7 in) wide, with no seal over the closure seam.

In Examples 1–4, a 6.7 cm by 27.6 cm (2 5/8 in by 10 7/8 in) Tyvek® elongated strip seal was placed over the closure seam, the seal being oriented parallel to the closure seam. The seal was adhered with HM-759 general purpose permanent pressure sensitive hot melt adhesive available from AccuBond Corporation.

In Examples 5–7, a 6.7 cm by 27.6 cm (2 5/8 in by 10 7/8 in) Tyvek® Elongated strip seal was placed over the closure seam, perpendicular to the closure seam. The seal was adhered with HM-759 general purpose permanent pressure sensitive hot melt adhesive available from AccuBond Corporation.

In Example 8, two 6.7 cm by 9.8 cm (2 5/8 in by 3 7/8 in) tab seals were placed at the two ends of the closure seam such that they wrapped around from one side of the containment envelope to the other. The seals were adhered with HM-759 general purpose permanent pressure sensitive hot melt adhesive available from AccuBond Corporation.

In Examples 9–13, a 13 cm by 5 cm (5 in by 2 in) Tyvek® Rectangular tab seal was placed over the closure seam, with the longer side of the tab oriented parallel to the closure seam. The seal was adhered with HM-759 general purpose permanent pressure sensitive hot melt adhesive available from AccuBond Corporation.

In Example 14, a 13 cm by 5 cm (5 in by 2 in) Tyvek® Rectangular tab seal was placed over the closure seam, with the longer side of the tab oriented perpendicular to the closure seam. One-third of the seal covered the envelope flap while two-thirds covered the envelope body. The seal was adhered with HM-759 general purpose permanent pressure sensitive hot melt adhesive available from AccuBond Corporation.

In Example 15, a 13 cm by 6.3 cm (5 in by 2½ in) Tyvek® Rectangular tab seal was placed over the closure seam, with the longer side of the tab oriented perpendicular to the closure seam. One-half of the seal covered the envelope flap while one-half covered the envelope body. The seal was adhered with HM-759 general purpose permanent pressure sensitive hot melt adhesive available from AccuBond Corporation.

In Example 16, three Tyvek® rectangular tab seals were placed over the closure seam, with one of the tabs located over the midpoint of the closure seam and the other two tabs located at the ends of the closure seam and wrapping around to the opposite side of the containment envelope. The center tab was 7.6 cm by 6.7 cm (3 in by 2⅝ in), and the other two tabs were 9.8 cm by 6.7 cm (3⅞ in by 2⅝ in). The tabs were adhered with HM-759 general purpose permanent pressure sensitive hot melt adhesive available from AccuBond Corporation.

In Example 17, a 27.6 cm (10⅞ in) length of a 5 cm (2 in) wide border tape elongated strip seal over the closure seam, parallel to the closure seam.

In Example 18, a 27.6 cm (10⅞ in) length of a 5 cm (2 in) wide masking tape (type 232 available from Minnesota Mining & Manufacturing, St. Paul, Minn.) elongated strip seal over the closure seam, parallel to the closure seam.

In Example 19, a 27.6 cm (10⅞ in) length of a 5 cm (2 in) wide duct tape (Nashua® 398, available from Tyco Adhesives, Norwood, Mass.) elongated strip seal over the closure seam, parallel to the closure seam.

In Example 20, a 27.6 cm (10⅞ in) length of a 5 cm (2 in) wide Tyvek® elongated strip seal over the closure seam, parallel to the closure seam. The seal was adhered with HM-759 general purpose permanent pressure sensitive hot melt adhesive available from AccuBond Corporation.

In Example 21–25, an 18 cm by 6.7 cm(7 in by 2⅝ in) Tyvek® elongated strip seal was adhered as the seal over the closure seam, parallel to the closure seam. The seal was adhered with HM-759 general purpose permanent pressure sensitive hot melt adhesive available from AccuBond Corporation.

In Example 26, a 27.6 cm by 6.7 cm (10⅞ in by 2⅝ in) Tyvek® label, coated with a pressure sensitive adhesive, supplied by FLEXcon (Spencer, Mass.), was adhered as the seal over the closure seam, parallel to the closure seam. A silicon pad was placed over the seal and a 2.3 kg (5 pound) weight was used to press the label onto the envelope.

In Examples 27–31, a 27.6 cm by 6.7 cm (10⅞ in by 2⅝ in) Tyvek® label, coated with a pressure sensitive adhesive, supplied by FLEXcon (Spencer, Mass.), was adhered as the seal over the closure seam, parallel to the closure seam. A silicon pad was placed over the seal and a 3.7 kg (8.2 pound) weight was used to press the label onto the envelope.

In Examples 32–36, a 6.7 cm by 27.6 cm (2⅝ in by 10⅞ in) Tyvek® elongated strip was adhered as the seal over the closure seam, parallel to the closure seam. The seal was adhered with HM-759 general purpose permanent pressure sensitive hot melt adhesive available from AccuBond Corporation. A silicon pad was placed over the seal and a 3.7 kg (8.2 pound) weight was used to press the label onto the envelope.

Unless stated otherwise in the foregoing examples, approximately one-half of the area of the seal was placed over the envelope flap and one-half of the area of the seal was placed over the envelope body.

The Creep Test results are shown in Table 1. The time-to-creep was measured in minutes and converted to seconds for ease of comparison of the data.

In the pressure vessels of Examples 17–20, after the tests were run, it was observed that the end of the containment envelope opposite the closure end had been ripped, although this did not appear to contribute to the failure of the pressure vessels.

In Comparisons 1–3, it was observed that the failure of the pressure vessel included failure at the air line entry port.

In Comparison 4, it was noted that the pressure crept up to 103 kPa (15 psi) for a time.

TABLE 1

| | Minutes | Seconds | Status |
|---|---|---|---|
| Comparison 1 | 2:39 | 159 | Burst |
| Comparison 2 | 3:22 | 202 | Burst |
| Comparison 3 | 3:17 | 197 | Burst |
| Comparison 4 | 1:35 | 95 | Burst |
| Comparison 5 | 1:41 | 101 | Burst |
| Comparison 6 | 2:13 | 133 | Burst |
| Comparison 7 | 3:52 | 232 | Burst |
| Comparison 8 | 4:04 | 244 | Burst |
| Comparison 9 | 3:37 | 217 | Burst |
| Comparison 10 | 16:05 | 965 | Burst |
| Comparison 11 | 10:00 | 600 | Burst |
| Comparison 12 | 14:02 | 842 | Burst |
| Example 1 | 10:00 | 600 | Intact |
| Example 2 | 19:00 | 1140 | Intact |
| Example 3 | 10:00 | 600 | Intact |
| Example 4 | 27:00 | 1620 | Burst |
| Example 5 | 16:50 | 1010 | Burst |
| Example 6 | 10:00 | 600 | Intact |
| Example 7 | 10:00 | 600 | Intact |
| Example 8 | 7:14 | 434 | Burst |
| Example 9 | 10:45 | 645 | Burst |
| Example 10 | 9:45 | 545 | Burst |
| Example 11 | 21:32 | 1292 | Burst |
| Example 12 | 7:00 | 420 | Burst |
| Example 13 | 5:41 | 341 | Burst |
| Example 14 | 5:30 | 330 | Burst |
| Example 15 | 3:48 | 228 | Burst |
| Example 16 | 10:30 | 630 | Burst |
| Example 17 | 3:00 | 180 | Burst |
| Example 18 | 12:47 | 767 | Burst |
| Example 19 | 37:28 | 2248 | Burst |
| Example 20 | 35:50 | 2150 | Burst |
| Example 21 | 16:14 | 974 | Burst |
| Example 22 | 17:36 | 1056 | Burst |
| Example 23 | 08:27 | 507 | Burst |
| Example 24 | 13:24 | 804 | Burst |
| Example 25 | 14:02 | 842 | Burst |
| Example 26 | 9:45 | 585 | Burst |
| Example 27 | 15:32 | 932 | Burst |
| Example 28 | 14:12 | 852 | Burst |
| Example 29 | 17:46 | 1066 | Burst |
| Example 30 | 14:58 | 898 | Burst |
| Example 31 | 14:48 | 888 | Burst |

TABLE 1-continued

| | Minutes | Seconds | Status |
|---|---|---|---|
| Example 32 | 22:12 | 1332 | Burst |
| Example 33 | 25:25 | 1525 | Burst |
| Example 34 | 25:49 | 1549 | Burst |
| Example 35 | 24:25 | 1465 | Burst |
| Example 36 | 26:42 | 1602 | Burst |

As can be seen from the data, the examples of the present invention are improvements over the comparison examples in maintaining the containment envelope intact before the creep failure occurs. While the envelopes without seals fail in 159–202 seconds, the Tyvek® seals fail from 1332 to 1620 seconds. Other effective seals are duct tape at 2248 seconds, masking tape at 767 seconds, and a Tyvek® label at 852 to 1066 seconds.

The widths of the seals tested are 5 cm (2 in) and 6.7 cm (2⅝ in) and both work. In fact, a single sample at the 5 cm (2 in) width resulted in a longer time-to-creep at 2150 seconds than the 6.7 cm (2⅝ in) seal. In general, the length of the seals appears to be proportional to the time-to-creep. A 12.7 cm (5 inch) wide sample resulted in time-to-creep from 341 to 1292 seconds, with an average around 600 seconds. Increasing this to 17.8 cm (7 in) gives 507 to 1056 seconds. The 27.6 cm (10⅞ in) long seals resulted in time-to-creep of 1332 to 2150 seconds.

Although only a few adhesives were tested, those skilled in the art will recognize that a wide variety of adhesives will work to adhere the seal to the containment envelope.

What is claimed is:

1. An improved pressure vessel, comprising:

a flexible, air permeable, liquid permeable, containment envelope having an interior cavity and an access opening closed by a closure and forming a seam;

a separate, flexible, air tight, liquid impervious, inner bladder having an interior cavity and an access opening, the inner bladder being disposed within the interior cavity of the containment envelope in an unexpanded state, wherein the inner bladder in a fully expanded condition outside of the containment envelope is larger than the interior cavity of the containment envelope; and a seal comprising a piece of flexible sheet material backed with an adhesive, said seal adhered to the exterior of the containment envelope over the seam, wherein said flexible sheet material and said adhesive forming said seal are selected such that said pressure vessel will withstand an internal pressure differential of at least 95 KPa for at least 10 minutes without inner bladder bursting.

2. The pressure vessel of claim 1 wherein the containment envelope comprises a spunbonded polyolefin plexifilamentary film-fibril material.

3. The pressure vessel of claim 2, wherein said seal is a spunbonded polyolefin plexifilamentary film-fibril flexible sheet material backed with a pressure sensitive adhesive.

4. The pressure vessel of claim 1 wherein the adhesive is selected from the group consisting of pressure sensitive adhesives and remoistenable adhesives.

5. The pressure vessel of claim 1 wherein the containment envelope and the seal have coordinating decorations printed thereon.

6. The pressure vessel of claim 1 wherein the piece of flexible sheet material adhered to the exterior of the containment envelope over the seam is an elongated strip of flexible sheet material and the length of the strip is parallel to the seam.

7. The pressure vessel of claim 1 wherein the piece of flexible sheet material adhered to the exterior of the containment envelope over the seam is an elongated strip of flexible sheet material and the length of the strip is perpendicular to the seam.

8. The pressure vessel of claim 1 wherein the seal comprises three pieces of flexible sheet material adhered to the exterior of the containment envelope over the seam wherein the three pieces are rectangular tabs of flexible sheet material, one tab being adhered generally over the midpoint of the seam and the other two tabs being adhered over the ends of the seam.

9. The pressure vessel of claim 1, wherein said seal is selected from the group consisting of spunbonded polyolefin plexifilamentary film-fibril flexible sheet material backed with a pressure sensitive adhesive, duct tape and masking tape.

* * * * *

UNITED STATES PATENT AND TRADEMARK OFFICE

CERTIFICATE OF CORRECTION

PATENT NO. : 6,817,764 B2 
DATED : November 16, 2004
INVENTOR(S) : O'Rourke Barbara Klimowicz, Lamontia Mark Allan and Mason Joseph Herbert It is certified that error appears in the above-identified patent and that said Letters Patent is hereby corrected as shown below:

Column 8,
Line 7, after "without" insert -- said --.

Signed and Sealed this

Nineteenth Day of April, 2005

JON W. DUDAS
*Director of the United States Patent and Trademark Office*